United States Patent [19]

Yang

[11] Patent Number: 5,048,127

[45] Date of Patent: Sep. 17, 1991

[54] INTERCHANGEABLE PRE-TIED NECKTIE

[75] Inventor: Philip S. Yang, Palos Verdes, Calif.

[73] Assignee: Viscount USA, Inc., Paramount, Calif.

[21] Appl. No.: 610,746

[22] Filed: Nov. 8, 1990

[51] Int. Cl.[5] ..... A41D 25/02; A41D 25/08

[52] U.S. Cl. ..... 2/149; 2/150; 2/152 R; 2/152 A; 2/153

[58] Field of Search ..... 2/149, 152 R, 152 A, 2/153, 145, 148, 150

[56] References Cited

U.S. PATENT DOCUMENTS

| | | | |
|---|---|---|---|
| 2,247,184 | 6/1941 | Burfening | 2/150 |
| 3,127,618 | 4/1964 | Roach | 2/150 |
| 4,513,453 | 4/1985 | Chen et al. | 2/153 X |
| 4,615,048 | 10/1986 | Grasser | 2/153 |
| 4,656,672 | 4/1987 | Lande | 2/153 X |
| 4,710,982 | 12/1987 | Lande | 2/153 X |
| 4,835,794 | 6/1989 | Chen et al. | 2/150 |
| 4,897,887 | 2/1990 | Chen et al. | 2/152 A X |

*Primary Examiner*—Werner H. Schroeder
*Assistant Examiner*—Jeanette E. Chapman
*Attorney, Agent, or Firm*—Lalos & Keegan

[57] ABSTRACT

A necktie comprising a knot support, an outer tie secured to the knot support and being positionable about the knot support to provide a knot, an inner tie releasably secured to the knot support comprising an upper loop to be worn about the neck of a wearer, an adjusting means positioned on the inner tie, and a tie end adjacent to the upper loop, the adjusting means including a grasping means having an aperture therein; and a securing means for releasably securing the inner tie to the knot support including a stud positioned on the rear surface of the knot support and a protruding securing means also positioned on the rear surface of the knot support, wherein the grasping means is located within the protruding securing means and the stud is positioned within the aperture of the grasping means when the inner tie is secured to the knot support.

8 Claims, 1 Drawing Sheet

INTERCHANGEABLE PRE-TIED NECKTIE

FIELD OF THE INVENTION

The present invention relates generally to pre-tied neckties and, more specifically, to a pre-tied necktie that is interchangeable with an inner tie to be worn around the wearer's neck.

Efforts have been made through various means to simplify the process of putting on a necktie. A conventional necktie requires that it be tied in place each time it is worn. This not only produces results that are inconsistent in terms of appearance of the necktie, but is also time-consuming. To alleviate these problems, there has been disclosed a necktie having a pre-tied knot which fits around the user's neck and is adjustable by means of a slidable zipper. Such a necktie is described in U.S. Pat. No. 3,127,618 to Roach. A pre-tied necktie has also been described in U.S. Pat. No. 4,513,453 to Chen et al, using a knot support to which the tie is fastened and about which the tie knot is made. The knot support is, in turn, fastened to a slider plate of the zipper which makes the tie adjustable around the wearer's neck. This use of the knot support in conjunction with an adjustable neck loop having a zipper allows for a quick tightening of the tie around the wearer's neck when the inner tie with the zipper adjustment is pulled down. The tie is further removed by simply pulling down the tie knot and the knot support which is attached to the zipper mechanism.

However, these types of pre-tied neckties requires that the wearer always use the same necktie unless a new one is separately purchased. This is inconvenient and costly for one who prefers use of an adjustable pre-tied necktie in that a complete pre-tied necktie is required to be purchased when a new tie, such as one of a different color or design, is desired.

In view of the foregoing, the present invention has been developed to provide a pre-tied necktie that is interchangeable with an inner tie, the disadvantage thereby avoiding to have to purchase an entirely new necktie assembly each time a new design is desired.

Accordingly, it is an object of the present invention to provide an improved pre-tied necktie.

A further object of the invention is to provide a pre-tied necktie having a zippered adjustable inner tie which is interchangeable with a knot support so that variety of different neckties can be used with the single zippered adjustable inner tie.

Other objects and advantages of the present invention will become more apparent to those persons having ordinary skill in the art to which the present invention pertains from the following description taken in conjunction with the accompanying drawings wherein.

Figure 2:
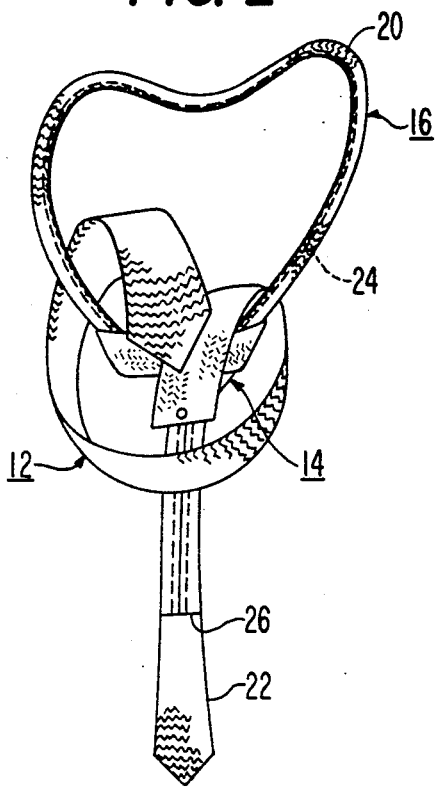
FIG. 2 is a perspective view of the invention shown in FIG. 1 showing a method of tying the necktie.
Figure 1:
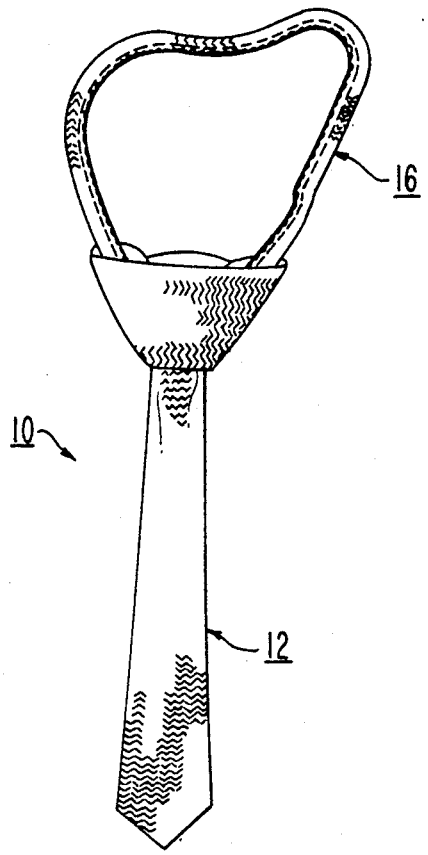
FIG. 1 is a perspective view of a preferred embodiment of the invention.

Referring to the illustration of the present invention shown in FIGS. 1-5, a interchangeable pre-tied necktie is shown generally as 10 and looks much like a conventional tie. Necktie 10 includes an outer tie 12 which is attached to a knot support 14. An inner tie 16 is releasably secured to knot support 14 by a securing means 18. As best seen in FIG. 2, outer tie 10 can be wrapped around knot support 14 as indicated to achieve the look of a conventional knot.

Figure 3:
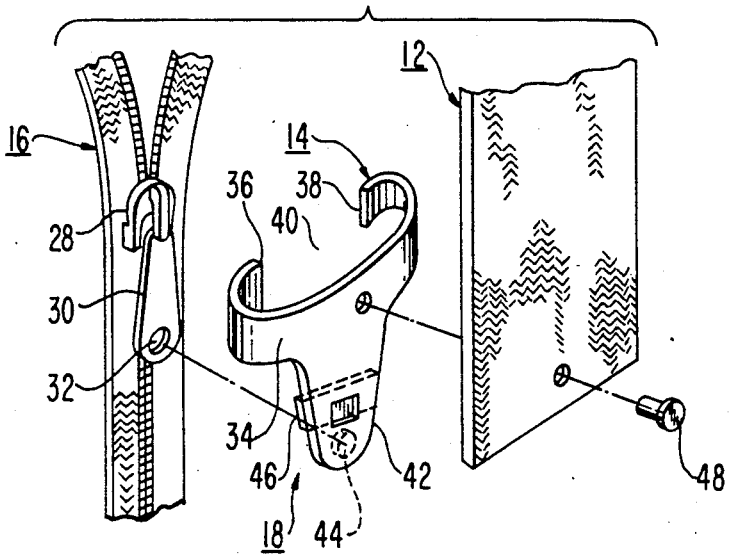
FIG. 3 is an exploded perspective view of the invention shown in FIGS. 1 and 2.

Inner tie 16 includes an upper loop 20 to be positioned around the neck of the wearer and a narrow tie end 22. Tie end 22 appears much like the smaller end of a conventional tie. Loop 20 has zipper teeth 24 positioned along its entire edge up to a point 26 where loop 16 meets tie end 22. As best seen in FIG. 3, a zipper slider 28 is positioned on inner tie 16 in mating relationship with teeth 24. Zipper slider 28 further includes a grasping means 30 having an aperture 32 therein.

Continuing to refer to FIG. 3, knot support 14 comprises an upper portion 34 that is generally of an oval shape when viewed from the top. Upper portion 34 has two end portions 36 and 38 extending toward the backside of upper portion 34 to provide an opening 40 in knot support 14. Opening 40 is adapted to receive loop 20 of inner tie 16 when the inner tie is attached to knot support 14. Extending downwardly from the front of knot support 14 is a tongue segment 42 having a stud 44 on its rear surface. Also on the rear surface of tongue segment 42 is a protruding receiving means 46 adapted to receive zipper slider 28 therein. Together, stud 44 and receiving means 46 form securing means 18.

Figure 4:
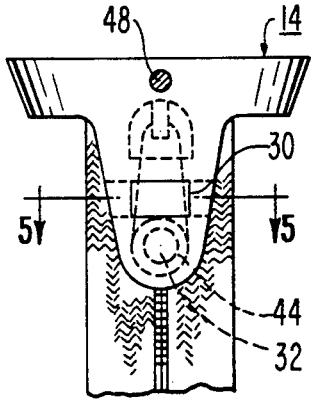
FIG. 4 is a front view of the knot support of the invention shown in FIGS. 1-3 when attached to the inner tie.
Figure 5:
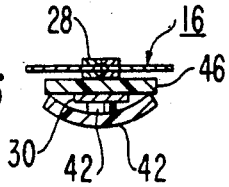
FIG. 5 is a top sectional view of the invention shown in FIGS. 1-4 taken along lines 5—5 of FIG. 4.

Outer tie 12 is attached to knot support 14 by means of a rivet 48 or any conventional fastening means. When inner tie 16 is releasably secured to knot support 14, grasping means 30 of zipper slider 28 is located within receiving means 46 and stud 44 is received within aperture 32. FIG. 4 shows the inner tie being releasably secured in this manner. This arrangement is best seen in FIG. 5, where the grasping means 30 is shown located between the tongue segment 42 and the protruding receiving means 46.

Knot support 14 can be made of a plastic material or any other suitable lightweight material that can be formed into the shape shown. Outer tie 12 can be made of conventional tie materials such as silk, polyester, or a combination thereof, and can be of a endless variety of colors, designs, and tie widths. Inner tie 16 can also be made of any conventional tie materials, and is preferably made of a neutral color which will be harmonious with any of the outer tie colors or designs. Further, zipper teeth of inner tie can be of metal, nylon or plastic as are conventional zippers.

In using the interchangeable pre-tied necktie, an outer tie 12 is first selected from the wide variety of colors and designs available. Each outer tie 12 will be attached to the knot support 14. The neutral inner tie 16 will then be secured to knot support 14 by placing the grasping means 30 into the protruding receiving means 46 until the stud 44 is aligned with the aperture 32 of the grasping means. At this point, a slight pressure applied to the tongue segment 42 will result in the stud 44 being received into the aperture 32. Inner tie 16 is then positioned within opening 40, and outer tie 12 can be tied into a knot of preference, such as that depicted in FIG. 2. The necktie is then ready to be worn by placing the upper loop 20 around the wearer's neck. While grasping the tie end 22 with one hand, the wearer can move the knot support 14 into place with the other hand. This is accomplished by moving the knot support 14 upwards toward the neck so that the zipper slider 28 moves along the teeth 24 of the loop until the knot support 14 is in a comfortable wearing position around the neck.

The necktie can easily be removed by pulling the knot support 14 downward until the loop 20 is large enough to fit over the wearer's head. The selected outer tie and knot support can then be removed from the inner tie by untying the knot and pulling outward on tongue segment 42 until the stud 44 is freed from the aperture 32 of the grasping means. At this point, the inner tie is once again separated from the outer tie and knot support.

It can be seen that a number of necktie combinations can be achieved with only one inner tie coupled with a variety of outer ties. A wide variety of tie selections can thus be made available for the wearer. For example, the neckties could be packaged to contain one inner tie and a set of five different ties for easy attachment to the inner tie. A wide selection of ties is available for a reduced cost, since only one inner tie need be provided.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention by considered as within the scope thereof as limited solely by the appended claims.

I claim:

1. A necktie comprising:

a knot support;

an outer tie secured to said knot support and being positionable about said knot support to provide a knot;

an inner tie releasably secured to said knot support comprising an upper loop to be worn about the neck of a wearer, an adjusting means positioned on said inner tie, and a tie end adjacent to said upper loop, said adjusting means including a grasping means having an aperture therein; and a securing means for releasably securing said inner tie to said knot support including a stud positioned on the rear surface of said knot support and a protruding securing means also positioned on a rear surface of said knot support;

wherein said grasping means is located within said protruding securing means and said stud is positioned within said aperture of said grasping means when said inner tie is secured to said knot support.

2. A necktie according to claim 1 wherein said adjusting means comprises a zipper slider, and said upper loop of said inner tie having zipper teeth positioned thereon, said zipper slider being disposed in mating relationship with said zipper teeth.

3. A necktie according to claim 1 wherein said knot support further comprises an upper portion having two end portions extending toward a backside of said upper portion to provide an opening therein, said opening being adapted to receive said inner tie when said inner tie is secured to said knot support.

4. A necktie according to claim 1 wherein said outer tie is permanently secured to said knot support by means of a rivet.

5. A necktie according to claim 1 wherein said knot support is formed of a plastic material, said securing means being an integral portion thereof.

6. An inner tie for a necktie having a knot support, an outer tie secured to said knot support and being positionable about said knot support to provide a knot, and securing means located on said knot support and including a stud and a protruding securing means positioned on a rear surface thereof, comprising:

an upper loop to be worn about the neck of a wearer, an adjusting means positioned on said inner tie, and a tie end adjacent to said upper loop;

said adjusting means including a grasping means having an aperture therein;

wherein said inner tie can be releasably secured to said necktie by said grasping means being located within said protruding securing means and said stud being positioned within said aperture of said grasping means when said inner tie is secured to said knot support.

7. A necktie according to claim 6 wherein said adjusting means comprises a zipper slider, and said upper loop of said inner tie having zipper teeth positioned thereon, said zipper slider being disposed in mating relationship with said zipper teeth.

8. A necktie according to claim 6 wherein said knot support further comprises an upper portion having two end portions extending toward a backside of said upper portion to provide an opening therein, said opening being adapted to receive said inner tie when said inner tie is secured to said knot support.

* * * * *